United States Patent [19]

Gunnewig

[11] Patent Number: 4,533,344

[45] Date of Patent: Aug. 6, 1985

[54] SELF-EMPTYING CENTRIFUGE DRUM

[75] Inventor: Hubert Gunnewig, Oelde, Fed. Rep. of Germany

[73] Assignee: Westfalia Separator AG, Oelde, Fed. Rep. of Germany

[21] Appl. No.: 629,937

[22] Filed: Jul. 12, 1984

[30] Foreign Application Priority Data

Jul. 23, 1983 [DE] Fed. Rep. of Germany ..... 3326708

[51] Int. Cl.[3] ..... B04B 7/16; B04B 7/18

[52] U.S. Cl. ..... 494/36; 494/40

[58] Field of Search ..... 494/36, 40, 41, 56, 494/67, 68, 69, 70, 71, 72, 73; 210/348, 360.1, 361, 380.1, 380.2; 196/46.1

[56] References Cited

U.S. PATENT DOCUMENTS 2,870,912 1/1959 Mathieu ..... 210/380.1
3,011,647 12/1961 Elsken ..... 494/36
3,283,910 11/1966 Grieselhuber ..... 210/369
3,415,446 12/1968 Weiland ..... 494/36
4,320,006 3/1982 Kikuchi ..... 210/380.1

*Primary Examiner*—Robert W. Jenkins
*Attorney, Agent, or Firm*—Sprung Horn Kramer & Woods

[57] ABSTRACT

A self-emptying centrifuge drum has at its periphery an annular gap between its cover and bottom. The gap can be opened and closed with a piston slide. The cover and bottom of the drum are connected by a strainer basket. The basket is rigid enough to ensure unexceptionable concentricity of the parts of the drum under all operating conditions. The position of the strainer basket in the immediate vicinity of the plate insert divides the centrifugation space into a separation space and a solids space in such a way that the sedimentation in the solids space is unaffected by the flow of liquid in the channels.

8 Claims, 4 Drawing Figures

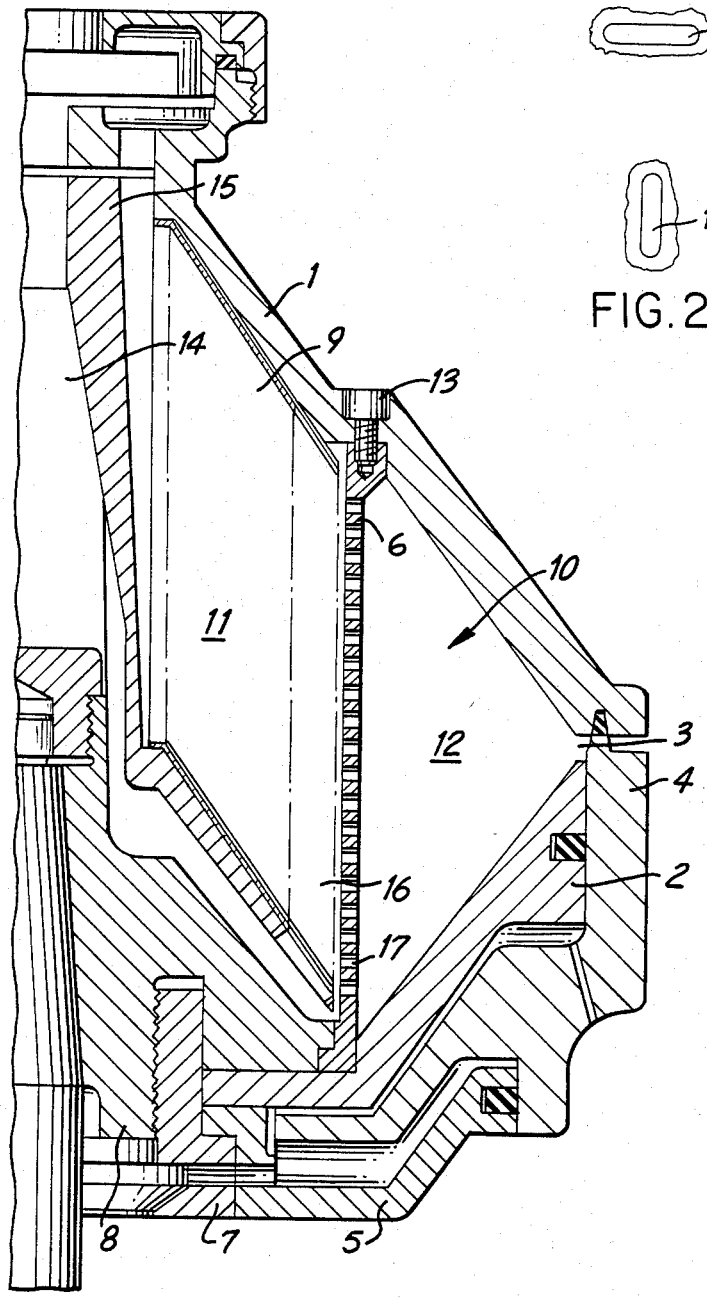
FIG. 1
FIG. 2A
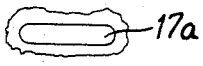
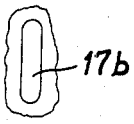
FIG. 2B
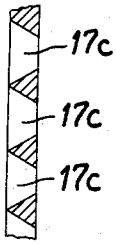
FIG. 2C

SELF-EMPTYING CENTRIFUGE DRUM

BACKGROUND OF THE INVENTION

The present invention relates to a self-emptying centrifuge drum for clarifying and separating liquids, consisting of parts that are rotation-symmetrically connected and having an annular gap in the vicinity of its longer diameter for letting off solids, the gap being constituted by two parts of the drum and capable of being opened and closed by a piston slide.

A centrifuge drum of this type is known, for example, from German OS 2 930 526. The parts that constitute the annular gap in that device are held together by bolts that are distributed uniformly around the circumference at the periphery of the drum.

Even when the bolts can be manufactured extraordinarily precise, however, the unavoidable differences in tolerance between them and the bores in the parts of the drum that accommodate them will allow all the parts to run unsatisfactorily out of true and will lead to undesired unbalances. Although this is admittedly claimed to be eliminated by the distribution of the bolts proposed in German OS 3 101 713, that solution leads to other matching sites that exhibit the same problems. Both solutions are also subject to the defect that the bolts can accept only tensile forces and no radial or tangential forces of the type that can occur when the drum empties. Centrifugal forces, moreover, will lead to flection of the bolts and accordingly to deformations, making the bolts unusable. Furthermore, mounting the bolts in the solids space of the drum makes it impossible to rule out wear in the case of erosive solids, so that the strength of the bolts will decrease with time.

SUMMARY OF THE INVENTION

The object of the present invention is to fasten the parts of the drum that constitute the annular gap together in such a way as to ensure unexceptionable operation of all parts of the drum subject to all conditions and to prevent radial and tangential displacement of the drum parts with respect to one another.

This object is attained in accordance with the invention in that the parts of the drum that form the annular gap are connected by a strainer basket that is mounted concentrically inside the drum. A strainer basket of this type is rigid enough to accept any forces that may occur and its concentric and single-part design also results in an operation that is just as satisfactory as in conventional centrifuge drums with extraction slots.

It is especially practical when the strainer basket immediately surrounds the outside diameter of the plate insert and hence divides the centrifugation space into a separation space and a solids space, preventing them from interacting undesirably.

In this embodiment of the invention the strainer basket is positively connected to the hub, making special attachments redundant at that point.

The cover of the drum is preferably attached to the strainer basket with screws, so that it will be easy to mount with commercially available tools. A preferred embodiment of the invention will now be described with reference to the attached drawing, wherein:

BRIEF DESCRIPTION OF THE DRAWING

FIG. 1 is a vertical section through half of the drum in accordance with the invention.

FIGS. 2A–2C shows three embodiments of the holes in the strainer basket of FIG. 1.

DETAILED DESCRIPTION OF THE PREFERRED EMBODIMENT

Referring now to FIG. 1, an annular gap 3 is left between the cover 1 and the bottom 2 of a the drum and can be opened and closed by a piston slide 4. The bottom 2 of the drum, the floor 5 of a closure chamber, and a strainer basket 6 are connected to the hub 8 of the drum by a threaded ring 7. Strainer basket 6 immediately surrounds plate insert 9, divides the centrifugation space 10 into a separation space 11 and a solids space 12. The cover 1 of the drum is attached to the free end of strainer basket 6 by screws 13. The material to be centrifuged is supplied to plate insert 9 through the inlet space 14 of a distributor 15 and through channels 16. The separated solids pass through the holes 17 in strainer basket 6 and accumulate in solids space 12. The accumulated solids can be let off by activating piston slide 4 before the next layer of solids arrives at strainer basket 6. The position of strainer basket 6 in the immediate vicinity of the outside diameter of the plate insert 9 screens off the radially occurring sedimentation process in solids space 12 from the vertical flow of liquid in channels 16 in an ideal way, preventing any interaction. Since strainer basket 6 is outside solids space 12, the basket cannot be eroded by solids while the drum is emptying.

The openings 17 in strainer basket 6 can be either a bore, as shown in FIG. 1, a horizontal slot 17*a* as in FIG. 2A or a vertical slot 17*b* as shown in FIG. 2B. It is practical for the bores or slots 17*c* to expand conically from the outside to the inside diameter of the basket, leaving only sharp webs at the inside diameter of the basket for the solids to settle on, as shown in FIG. 2C.

It will be appreciated that the instant specification and claims are set forth by way of illustration and not limitation, and that various modifications and changes may be made without departing from the spirit and scope of the present invention.

What is claimed is:

1. In a self-emptying centrifuge drum for clarifying and separating liquids, having two parts including a bottom and a cover and means rotation-symmetrically connecting the two parts to form an annular gap in the vicinity of the longest diameter for letting off separated solids, a plate insert for separating off solids and a piston slide for opening and closing the gap, the improvement wherein the connecting means comprises a strainer basket mounted concentrically inside the drum to surround the plate insert and means connecting an upper portion of the basket to the cover and a lower portion of the basket to the bottom, the basket being sufficiently rigid to prevent radial and tangential displacement of the bottom and cover with respect to each other and wherein the basket has a plurality of openings configured to allow separated solids from the plate insert to pass therethrough.

2. A self-emptying centrifuge drum as in claim 1, wherein the strainer basket immediately surrounds the outside diameter of the plate insert.

3. The self-emptying centrifuge drum as in claim 1, wherein the drum has a hub and wherein the connecting means further comprises means positively connecting the strainer basket to the hub.

4. The self-emptying centrifuge drum as in claim 1, wherein the cover of the drum is attached to the stainer basket with screws.

5. The self-emptying centrifuge drum as in claim 1, wherein the openings in the strainer basket are bores.

6. The self-emptying centrifuge drum as in claim 1, wherein the openings in the strainer basket are horizontal slots.

7. The self-emptying centrifuge drum as in claim 1, wherein the openings in the strainer basket are vertical slots.

8. The self-emptying centrifuge drum as in claim 1, wherein the openings in the strainer basket expand conically from the outside to the inside diameter of the basket.

* * * * *